US006766806B2

(12) United States Patent
Thiebaut

(10) Patent No.: US 6,766,806 B2
(45) Date of Patent: Jul. 27, 2004

(54) DEVICE AND METHOD FOR APPLYING A PRODUCT

(75) Inventor: Laure Thiebaut, Clichy (FR)

(73) Assignee: L'Oreal, Paris (FR)

( * ) Notice: Subject to any disclaimer, the term of this patent is extended or adjusted under 35 U.S.C. 154(b) by 0 days.

(21) Appl. No.: 10/035,208

(22) Filed: Jan. 4, 2002

(65) Prior Publication Data

US 2002/0092538 A1 Jul. 18, 2002

(30) Foreign Application Priority Data

Jan. 4, 2001 (FR) ..... 01 00084

(51) Int. Cl.[7] ..... A45D 24/26
(52) U.S. Cl. ..... 132/112; 401/263
(58) Field of Search ..... 132/112, 116, 132/207, 126, 129, 136, 142, 313; 401/270, 272, 275, 280, 156, 159, 263, 126, 127

(56) References Cited

U.S. PATENT DOCUMENTS

| | | | | | |
|---|---|---|---|---|---|
| 971,250 | A | * | 9/1910 | Charles | 132/112 |
| 1,005,412 | A | * | 10/1911 | Charles | 132/112 |
| 2,897,826 | A | * | 5/1959 | Di Vito | 132/114 |
| 3,363,968 | A | * | 1/1968 | Williams | 401/28 |
| 3,446,216 | A | * | 5/1969 | Sala | 132/116 |
| 3,570,499 | A | | 3/1971 | Ruta | |
| 3,961,635 | A | * | 6/1976 | Miya | 132/113 |
| 4,090,522 | A | | 5/1978 | Donley et al. | |
| 4,143,982 | A | * | 3/1979 | Cox et al. | 401/280 |
| 4,294,270 | A | * | 10/1981 | Cochran | 132/112 |
| 4,615,635 | A | * | 10/1986 | Kim | 401/270 |
| 5,318,051 | A | * | 6/1994 | Koppel | 132/116 |
| 5,343,880 | A | * | 9/1994 | McKay | 132/116 |
| 5,797,692 | A | * | 8/1998 | Poole et al. | 401/266 |
| 5,937,866 | A | * | 8/1999 | Magharehi | 132/116 |
| 6,213,129 | B1 | * | 4/2001 | Muldoon | 132/120 |

FOREIGN PATENT DOCUMENTS

| | | | | |
|---|---|---|---|---|
| DE | 89 06 735 | | 10/1989 | |
| DE | 89 12 220 | | 3/1990 | |
| EP | 276-713 A | * | 3/1988 | 132/112 |
| FR | 2 744 890 | | 8/1997 | |
| GB | 1 422 081 | | 1/1976 | |
| WO | WO 88/09632 | | 12/1988 | |

OTHER PUBLICATIONS

Patent Abstracts of Japan, vol. 1997, No. 03, Mar. 31, 1997 (JP 08 289816).
English language Derwent Abstract of FR 2 744 890, Aug. 22, 1997.

* cited by examiner

*Primary Examiner*—Eduardo C. Robert
*Assistant Examiner*—David Comstock
(74) *Attorney, Agent, or Firm*—Finnegan, Henderson, Farabow, Garrett & Dunner, L.L.P.

(57) ABSTRACT

The present application relates to a device for applying a product, comprising a container configured to contain the product and an applicator head associated with the container. The applicator head comprises a plurality of applicator elements having a base and a free end, at least one opening communicating with the container and being configured to allow the product to be delivered outside the applicator elements at a location closer to the base than the free end, and a movable support configured to be movable between a first position in which the at least one opening is closed off and a second position in which the at least one opening is at least partially uncovered. In addition, at least some of the applicator elements are mounted on the movable support.

39 Claims, 7 Drawing Sheets

DEVICE AND METHOD FOR APPLYING A PRODUCT

The present invention relates to a unit for applying a product, such as a hair product (for example, a styling gel or a coloration product) that may be in the form of a cream, for example.

In this application, for reasons of simplification, when referring to a user, "he" or "his" will be used to denote, without preference, someone of the male or of the female sex.

Hair gels are typically applied by hand, which involves the user, after applying the gel, washing his hands. Experience has shown that most users who have applied gel with their hands will run a comb or a brush through their hair, so as to tidy it, or give it the desired set. In many instances, the comb then is usually rinsed. From a practical point of view, any or all of this may be unsatisfactory to a user.

Devices of the type with applicator teeth are known for applying a hair gel. The product is conveyed either to the base of the teeth or to their tips, via a channel which passes axially through the teeth.

An example of such devices is described in particular in U.S. Pat. No. 3,570,499. In that document, the applicator elements consist of teeth through which there passes a channel which opens to the tip of the teeth, and these teeth are fed from a reservoir made of flexible material that has to be punctured with a needle prior to first use.

Another arrangement in which the product is distributed via a channel passing axially through a number of teeth is described in U.S. Pat. No. 4,090,522.

FR-A-2 744 890 describes a device, equipped with a reservoir in the form of a bellows, and surmounted by an arrangement of teeth, at the base of which a number of orifices open. The applicator head is capped by a removable lid.

A similar device is described in GB-A-1 422 081.

Devices comprising a container surmounted by an applicator head comprising a number of teeth, at the base of which orifices open, are also described in German Utility Models 89 06 735.5 and 89 12 220.8. In those documents, between two uses the orifices are closed off by means of an auxiliary closure element, mounted either slidably or pivotably on the applicator head. The closure element comprises means capable, when the closure element is in the closed position, of engaging with the orifices so as to close them off. The closure element may be either fixed permanently to the device, particularly via an articulation, or may be detached from the device at the time of application.

WO-A-88/09632 describes an applicator device, particularly for a coloration product, comprising an arrangement of teeth, at the base of which there open orifices in communication with a container containing the product that is to be applied. That document envisages no way of directly closing off the orifices.

The problems inherent to all these devices are numerous. Because of the arrangement of the orifices, namely usually between the teeth of one and the same row, or at the tips of the teeth, the product emerges directly onto the region that is to be treated, in the plane of the teeth, with the teeth serving only to guide the placement of the product. When the applicator device is run through the hair, there is therefore simultaneity between the product coming into contact with the hair, and the run-through with the applicator teeth. Uniform distribution of the product onto the hair therefore requires, in many cases, an additional run through the hair either using the applicator device itself or using an auxiliary comb.

In systems with an auxiliary closure element, sliding or articulated, as described in the two German utility models mentioned hereinabove, in its retracted (or open) position, the closure element interferes with the movement of the device through the hair, and can interfere with the correct application of the product. Furthermore, there is a risk that in its retracted position such a closure element might be broken or damaged. Finally, when the closure element is in the closed position, this element makes such an applicator device difficult to use in the manner of a simple comb. Such use, without depositing any additional product, may be desirable after applying the product, in order to improve the styling of the hair.

Furthermore, in some arrangements that use a closure element that can be detached from the applicator head with a view to making an application, the risk of forgetting to return it to the applicator head after use, or indeed losing it, is not insignificant.

Hence, one of the aspects of the invention is to produce a device for applying a hair product that completely or partially solves one or more of the problems discussed hereinabove with reference to the prior art.

One aspect of the invention is to produce an applicator device which may be simple to use and economical to produce.

Another aspect of the invention is to produce an applicator device that may make it possible, in a single action, to apply the product and to spread it uniformly through the hair.

Yet another aspect of the invention is to produce a device that may be used after the product has been applied, in the manner of a comb, to improve the styling of the hair.

Yet another aspect of the invention is to produce an applicator device equipped with a member that may be capable of, in a storage position, sealing off at least one orifice communicating with a container, and that may not interfere with the movement of applicator elements through the hair, either in the position in which the at least one orifice is closed off or in the position where it is uncovered.

Yet more aspects may become apparent in the detailed description that follows. It should be understood that certain principles of the invention could be practiced without involving one or more of the aspects discussed herein.

In one aspect, there is a device for applying a product, comprising a container configured to contain the product. The container may be associated with an applicator head comprising a plurality of applicator elements having a base and a free end, at least one opening communicating with the container and being configured to allow the product to be delivered outside of the applicator elements at a location closer to the base than the free end of the applicator elements (for example in the vicinity of the base), and a movable support that is movable between a first position in which the opening is closed off and a second position in which the opening is at least partially uncovered. Additionally, at least some of the applicator elements may be mounted on the movable support.

Within the meaning of the current application, the term "in the vicinity of", where qualifying the position of the at least one opening, means that the at least one opening may open some distance from the free end of at least some of the applicator elements, such as closer to their base than to their free end. Also as an option, the opening may open directly onto the surface on which the applicator elements are located.

In one exemplary embodiment, the opening/closing of the at least one orifice communicating with the container may be provided by the movable support on which at least some of the applicator elements themselves are located; thus, optionally making it possible to generate practically no interference likely to interfere with application or with styling the hair, when the device is moved through the hair.

The device thus configured may be simple to use and economical to produce. Additionally, the opening/closing of the at least one orifice communicating with the container may be provided by the movable support on which the applicator elements themselves are located. This may give greater flexibility in the configuration of the applicator elements, such as in the choice of their number, their spacing, and in the choice of their dimensions (e.g., length and cross section).

In an alternative aspect, the applicator elements may be configured in the form of a row mounted on the movable support. In such a configuration, when the movable support is in the second position, the at least one opening may be outside the mean plane containing the row of applicator elements. Thus, unlike certain conventional devices in which the orifices are aligned with the row of teeth, this may make it possible, to first deposit the product on the hair and then to spread it out uniformly using at least a portion of the applicator elements. This results from the fact that, with respect to the movement of the device through the hair, the at least one orifice may be upstream of at least some of the applicator elements.

According to another aspect, the device may be configured wherein the aforementioned row of elements comprises a first row and the device further comprises a second row mounted fixedly on the applicator head. With this configuration, the at least one opening may be outside the mean plane containing the second row of applicator elements. The first row of applicator elements may be mounted on the support in such a way as to move with respect to the second in a direction substantially perpendicular to the latter. The first row, therefore, may play a part in untangling the hair prior to the application of the product, and the second row may be used for aiding in spreading product or other finishing activities after product has been initially applied.

The applicator elements of the first row may, therefore, differ from the applicator elements of the second row in at least one characteristic, such as the characteristic of length, spacing, or cross section. For untangling, for example, use may be made of a comb with coarse, fairly widely-spaced teeth. For finishing, among other activities, use may be made of a finer-toothed comb with the teeth more closely spaced.

As an alternative option, when the movable support is in the second position, the at least one opening may be arranged on one side of the first row or between the first row and the second row.

According to one aspect, the at least one opening may comprise at least one slot oriented parallel to the row(s) of applicator elements, and with a length roughly equal to the length of the row(s) of applicator elements. Its width may be of the order of approximately 0.5 mm to approximately 3.0 mm. Alternatively, it may be possible to use a number of disjointed orifices, arranged in particular in the form of a row parallel to the row(s) of applicator elements. It may also be equally possible to use a number of fine parallel slots, extending over practically the entire length of the row(s) of teeth, the relative position between the support and the fixed part of the applicator head determining the number of slots through which the product can emerge during application, thus making it possible to alter the rate at which the product is delivered.

Within a row, the applicator elements may have identical or different lengths. Thus, the tips, or free ends, of the applicator elements may run in a straight or curved line, for example, a concave line, which may allow the row of elements to follow the curvature of the skull.

The container itself may comprise at least one compressible (for example, elastically compressible) wall so that, in response to pressure exerted transversely or axially on the wall, raised pressure may be generated inside the container. This raised pressure in the container may then be able to expel the product through the at least one opening when the support is in the second position. Such a configuration of the container, such as in the form of a tube or tube bottle, may play a part in making it easier to dispense a highly viscous product, such as a hair-coloration gel or cream. According to one option, the compressible wall may be formed of a portion of the body of the container and configured in the form of a bellows to be axially compressed.

The container may be made, in full or in part, of a material chosen from polyethylenes; for example, low-density or very-low-density polyethylenes; polyvinyl chlorides; or complexes based on aluminum, or of the polyethylene/ethylene vinyl alcohol (EVOH)/polyethylene type.

The container may optionally be secured to a handle for holding that may be formed, for example, on an end wall of the container. In such a configuration, the applicator device may be "slipped on" the hand similar to a glove. This arrangement may be well suited to a container configuration in which at least part of the body forms a bellows.

The applicator head may be mounted on the container, for example, by snap-fastening, screwing, bonding, or welding.

A sealing member may also be provided for improving the sealing of the at least one opening when the movable support is in the first position. Such a sealing member may be formed of a bulge capable of mating with a corresponding profile formed by the edges delimiting the at least one opening.

In addition, a locking arrangement may be provided that is configured to reversibly lock the movable support in the first and/or the second position. This reversible locking may be fulfilled, at least in part, by the bulge on the movable support. At least one indent may also be provided in the applicator head in a location other than the opening for receiving the bulge in either or both of the first and/or second position(s).

In an optional aspect, the support may be slidably mounted on the applicator head.

Also, according to another aspect, the applicator head may be mounted removably on the container. This may then produce a device that can be refillable.

In another aspect, a removable lid may be provided to cap the applicator head, for example, when the device is being carried around, thus protecting it against potential soiling that may be caused by the external environment, or vice versa.

According to yet another aspect, a method may be provided for applying product comprising providing a device, passing product from the container and onto the applicator head via the at least one opening, and placing the applicator elements in contact with a location to apply product to the location.

In another aspect, the method may further comprise moving the movable support to the first position before the passing of the product. The method may also comprise moving the movable support to the second position after the product is applied.

In one option, the method may include applying a hair product to hair.

The accompanying drawings are included to provide a further understanding of the invention and are incorporated in and constitute a part of this specification. The drawings illustrate exemplary embodiments of the invention and, together with the description, serve to explain certain principles. In the drawings, FIG. 1 is an assembly view of an exemplary embodiment of an applicator device;

Reference will now be made in detail to exemplary embodiments of the invention, examples of which are illustrated in the accompanying drawings. Wherever possible, the same reference numbers are used in the drawings and the description to refer to the same or like parts.

Figure 1:
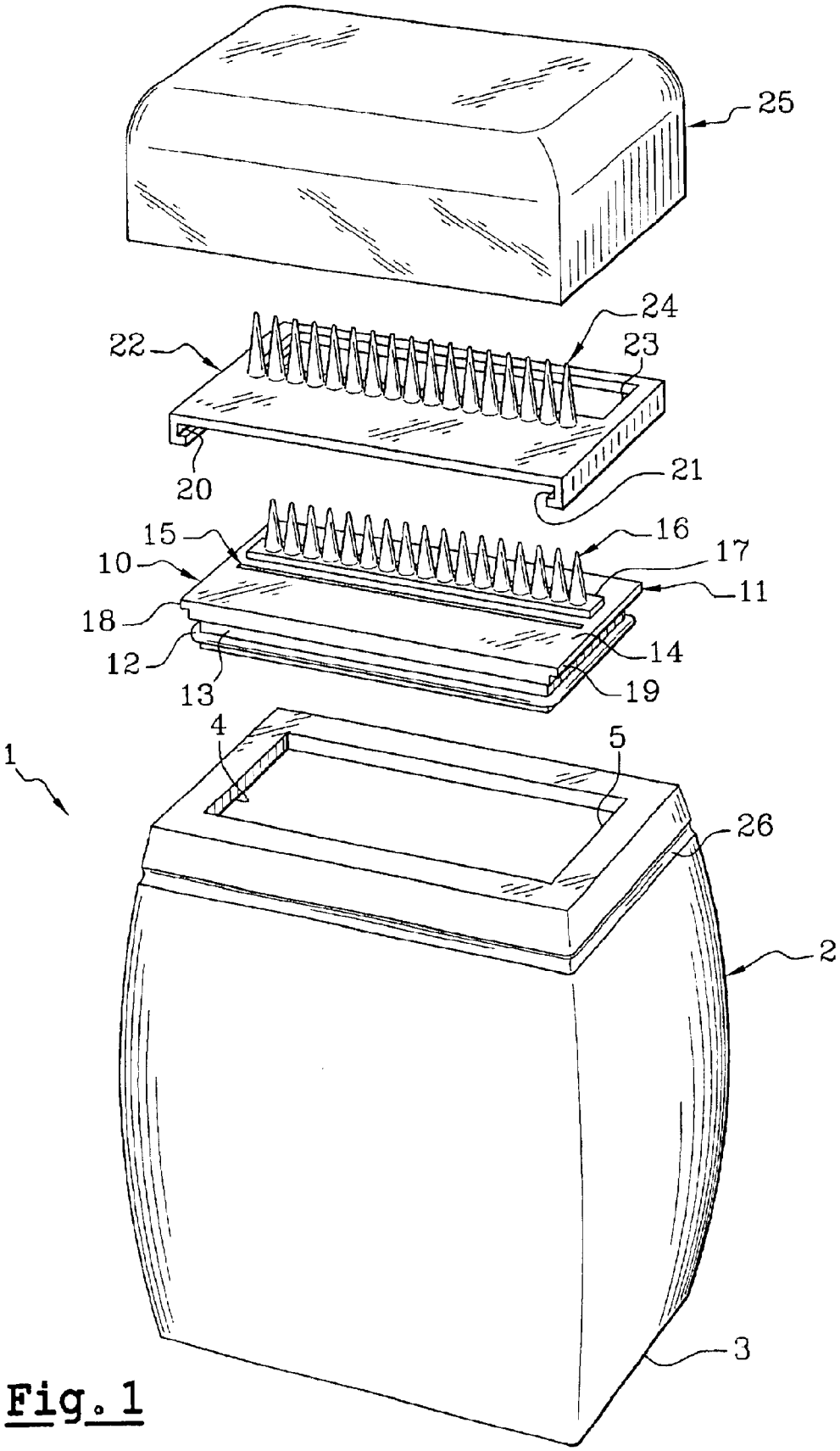
Figure 2:
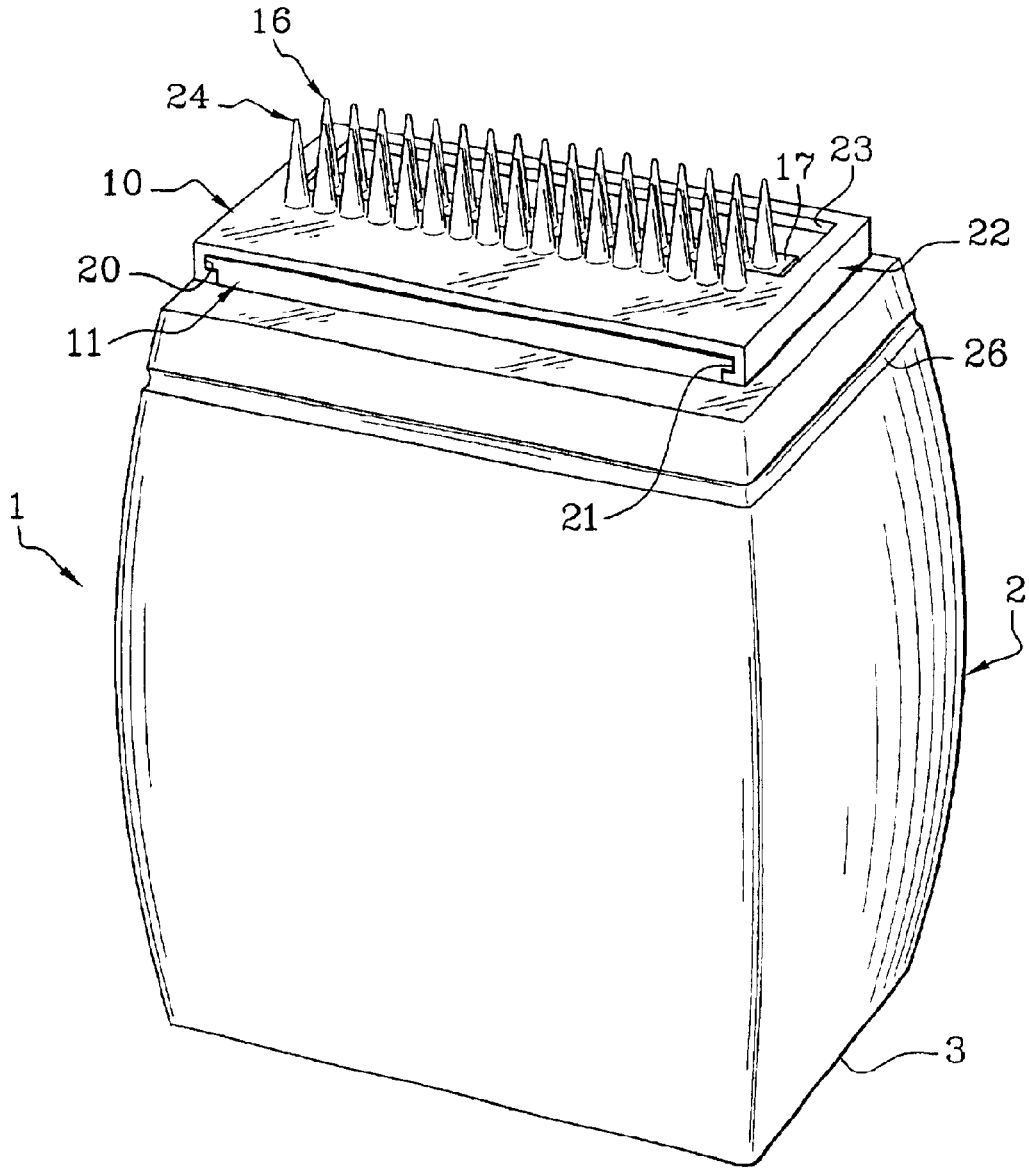
FIG. 2 is a perspective view of the assembled device of FIG. 1.

In the form of a first exemplary embodiment depicted in FIGS. 1, 2, 3A–3B and 4, the device 1 comprises a container 2 in the form of a bottle of a generally bulging parallelepipedal overall shape, its cross section being elongated along an axis of greatest length, and having one end closed by an end wall 3. The other end has an edge 4 delimiting an opening 5, the cross section of which is similar to that of the bottle.

Mounted on the bottle 2 is an applicator head 10. The applicator head 10 comprises a band 11 mounted fixedly on the container 2. For this purpose, the band 11 comprises a bulge 12 formed on the exterior surface of a lateral skirt 13 and capable of collaborating in snap-fastening with the edge 4 of the container, although other manners of fastening may be contemplated by those of skill in the art, such as bonding, screwing or welding, for example. The lateral skirt has one open end and one end substantially closed by a transverse wall 14.

Essentially at its middle, the transverse wall 14 has, passing through it, a slot 15 extending over roughly its entire length along the axis of greatest length of wall 14. Parallel to the slot 15, there runs a row of teeth 16 that is formed on a raised portion 17 of the wall 14. The length of the row of teeth 16 is practically equal to the length of the slot 15. The base of each of the teeth in the row 16 are a few mm away from the slot 15.

At each of its ends (along the axis of greatest length), the band 11 ends in an edge 18, 19 capable of sliding in a corresponding slideway 20, 21 formed in each of the ends of a movable support 22 of the applicator head 10.

The movable support 22 has dimensions similar to those of the band 11 and has an aperture 23 of a width greater than the width of the raised portion 17 of the band so that, as will be seen in greater detail later on, the support 22 is allowed to slide with respect to the band 11 in a direction substantially perpendicular to the axis of greatest length of the device 1. The length of the aperture 23 along the axis of greatest length of the device 1 is slightly greater than the length of the raised portion 17.

On one side of the aperture 23, there lies another row of teeth 24 of a length roughly identical to the length of the row of teeth 16. According to this embodiment, the teeth of the row 16 are the same height as the teeth of the row 24.

A lid 25 is intended, once the applicator head 10 has been fitted, to removably cap applicator head 10. Having a capped applicator head may be useful, for example when the device 1 is being carried around by a user, among other useful situations. A groove 26 formed on the container in the vicinity of the opening 5 allows the lid 25 to clip reversibly on to the device 1.

Figure 3A:
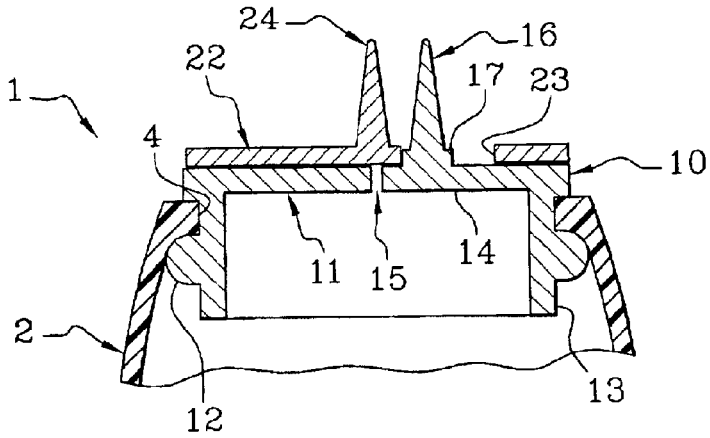
FIGS. 3A and 3B are partial section views of an upper portion of the device of FIG. 1, showing two position for a movable support in relation to an applicator head.

The way that device 1 works, as has just been described, will now be discussed with reference to FIGS. 3A, 3B, and 4. In the position of FIG. 3A, the movable support 22 is aligned with the band 11. In this position, the edge of the aperture 23 adjacent to the row of teeth 24 is in abutment against the corresponding edge of the raised portion 17 of the band 11. The movable support 22 covers the slot 15 and closes it off so that it is sealed against the product. This position corresponds to a storage position. In this position, the row of teeth 24 is essentially at the same level as the slot 15.

Figure 3B:
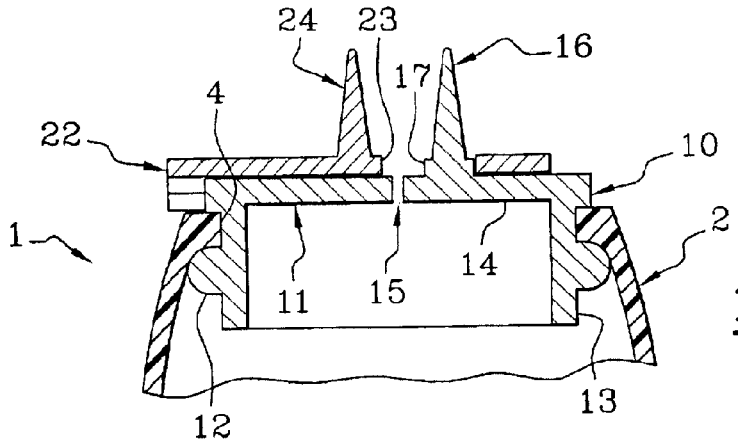
Figure 4:
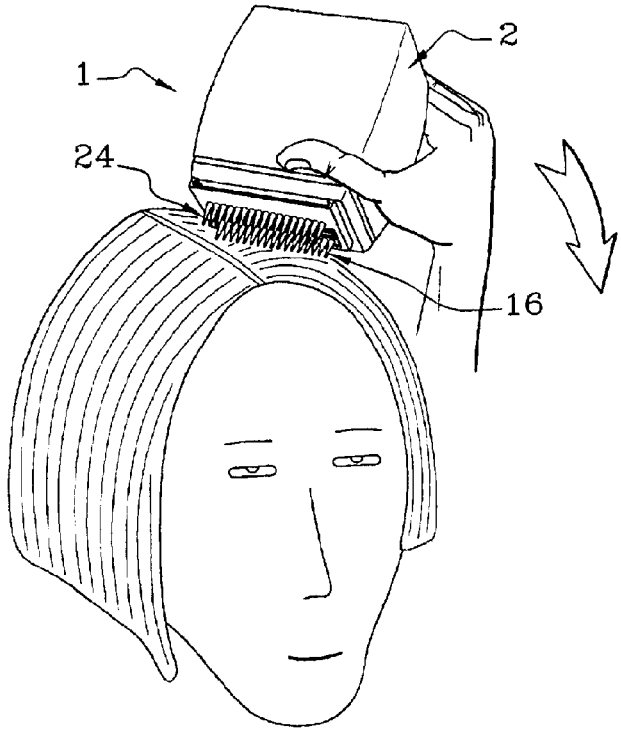
FIG. 4 is a perspective view of a user using the device of FIG. 1.
Figure 5:
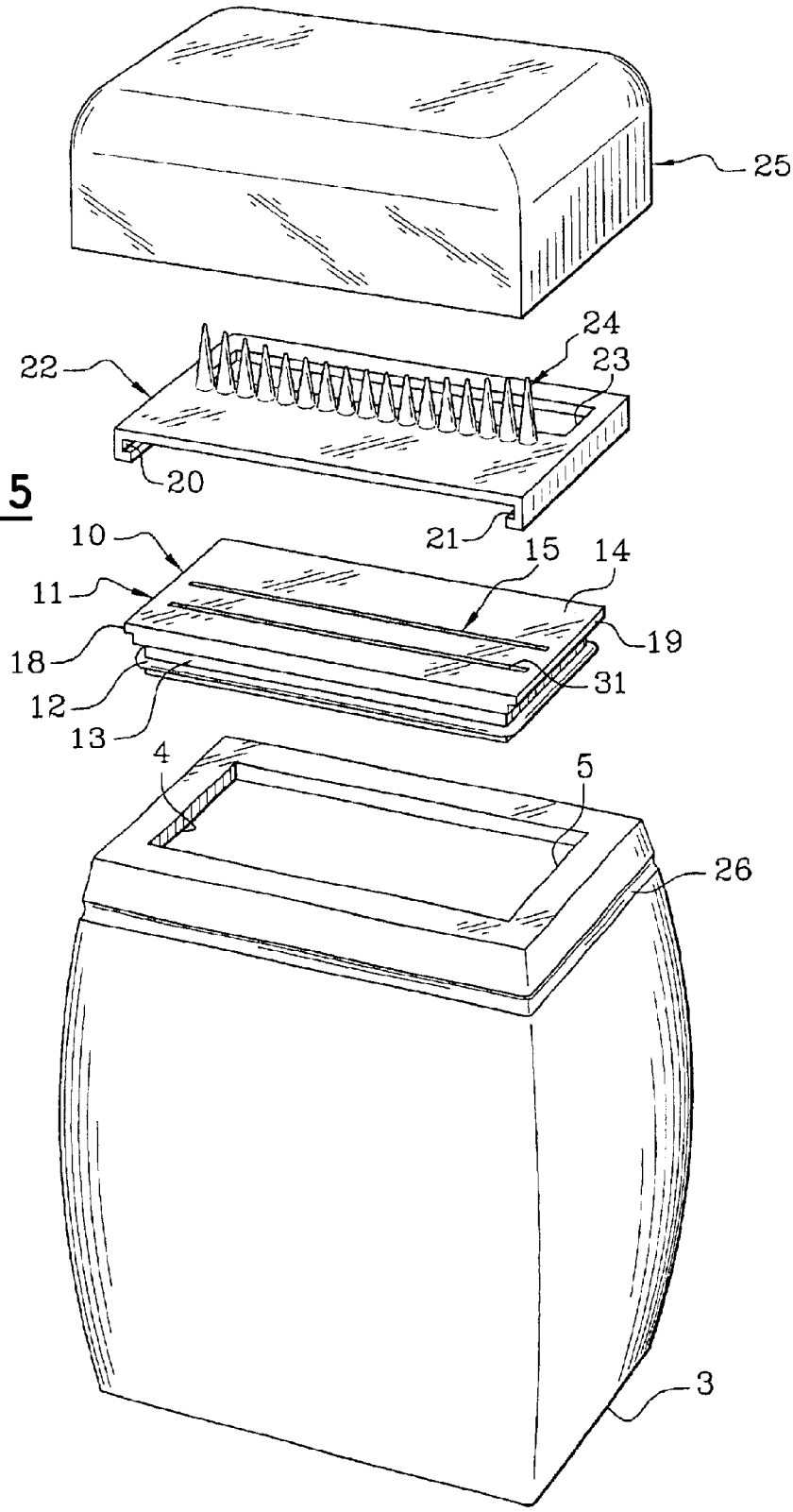
FIG. 5 is an assembly view of another exemplary embodiment of the applicator device.
Figure 6:
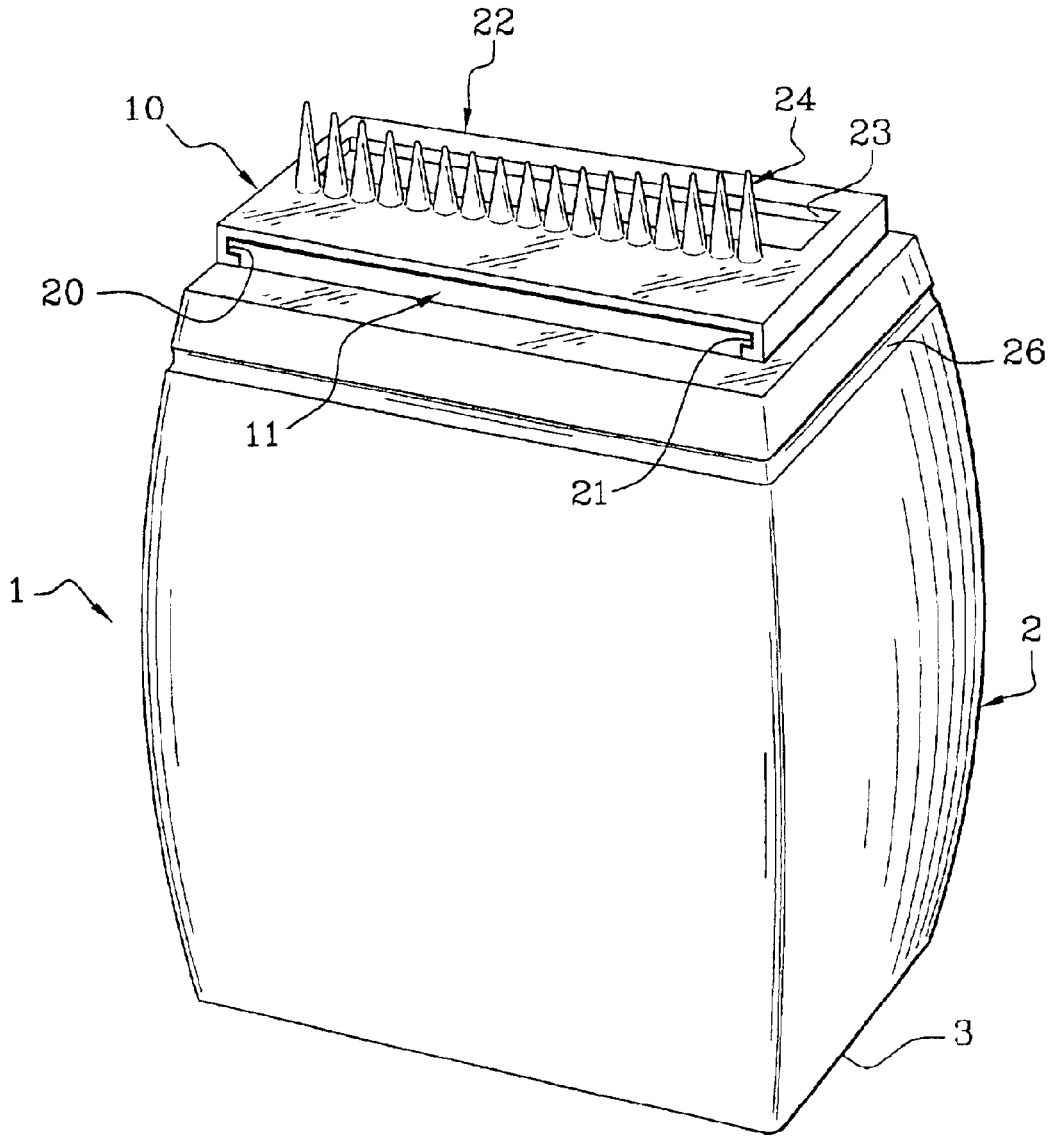
FIG. 6 is a perspective view of the assembled device of FIG. 5.

In the position of FIG. 3B, or a dispensing position, the movable support 22 has been moved perpendicular to the axis of greatest length of the device 1 until the opposite edge of the aperture 23 to the row of teeth 24 is in abutment against the corresponding edge of the raised portion 17 of the band 11. In this position, the slot 15 faces the aperture 23. It is therefore uncovered, and the product can be applied in a way depicted in FIG. 4. Typically, the maximum travel to move from the position of FIG. 3A to that of FIG. 3B is on the order of approximately 5 mm. It may be possible to choose to apply the product in an intermediate position between these two extreme positions. In such an intermediate position, the slot 15 may be only partially uncovered, and the rate at which the product is delivered may thus be adjusted at will.

To use the device, such as for applying a product, for example, a coloring cream, the user may slide the movable support 22 with respect to the band 11 so as to at least partially uncover the slot 15. He may then turn device 1 over so as to engage the rows of teeth 16 and 24 with the scalp, hair or other desired location. He may then press the walls of the container 2 so as to force the product out, via the slot 15, between the two rows of teeth 16 and 24. At approximately the same time, he may run the device 1 over the hair so as to apply it to the desired locations. During the movement, as depicted by the arrow, the device 1 may be turned so that the slot 15 does not close back up under the effect of the resistance put up by the hair. When using device 1 in this manner, the user may orient the device 1 so that, as it travels through the hair, the fixed row 16 is upstream from either the slot 15 or the other row of teeth 24.

Unlike the depiction in the drawing, when applying a styling gel, for example, the applicator device may generally be run from the front of the head backwards.

The row of teeth 16 may prepare the hair by, for example, untangling it before being brought into contact with the product contained between the two rows of teeth 16 and 24. Next, the row of teeth 24 may spread the product uniformly over the hair.

During a possible finishing step, the user may return the device 1 to the position of FIG. 3A and use it like a comb to improve the styling of the hair. In this finishing step, he may orient the device 1 in the opposite way to the orientation it had during application (i.e. with row 24 upstream of row 16), so that the resistance put up by the hair does not cause the movable support 22 to move and cause inadvertent uncovering of the slot 15.

After use, he may run the applicator head 10 under the tap to rid it of any product residue likely to dry between two uses.

The embodiment of FIGS. 5, 6 and 7A–7B differs from the previous embodiment, mainly in that:

1. —It has a single row of teeth 24. Thus, unlike the previous embodiment, the band 11 has no row of teeth.
2. —The tips of the teeth of the row 24 run in a concave line so as to follow the domed profile of the skull.
3. —Reversible locking of the applicator head 10 in the open position and in the closed position, respectively, is provided by means of a bulge 30 formed on the interior face of the movable support 22. The bulge 30 lies roughly level with the row of teeth 24, over a length roughly identical to that of the slot 15.

Figure 7A:
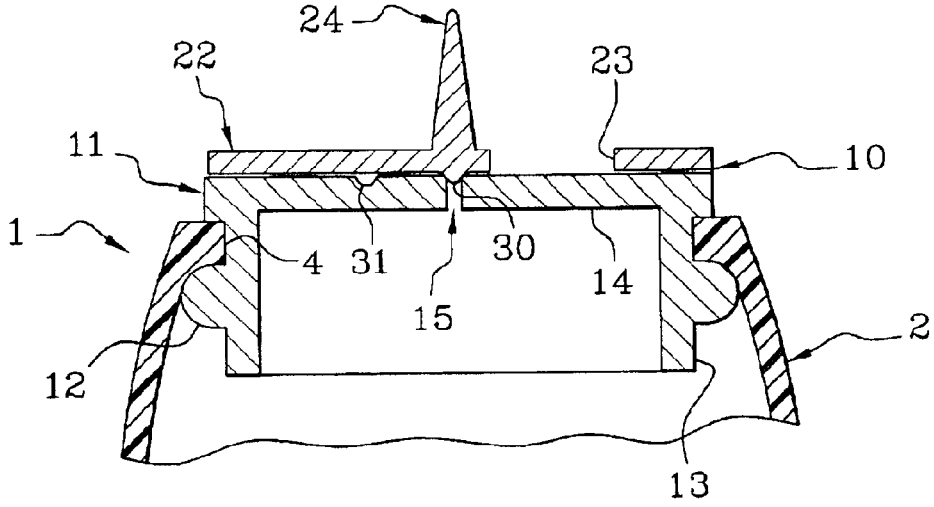
FIGS. 7A and 7B are partial section views of an upper portion of the device of FIG. 5, showing two positions for a movable support in relation to an applicator head.
Figure 7B:
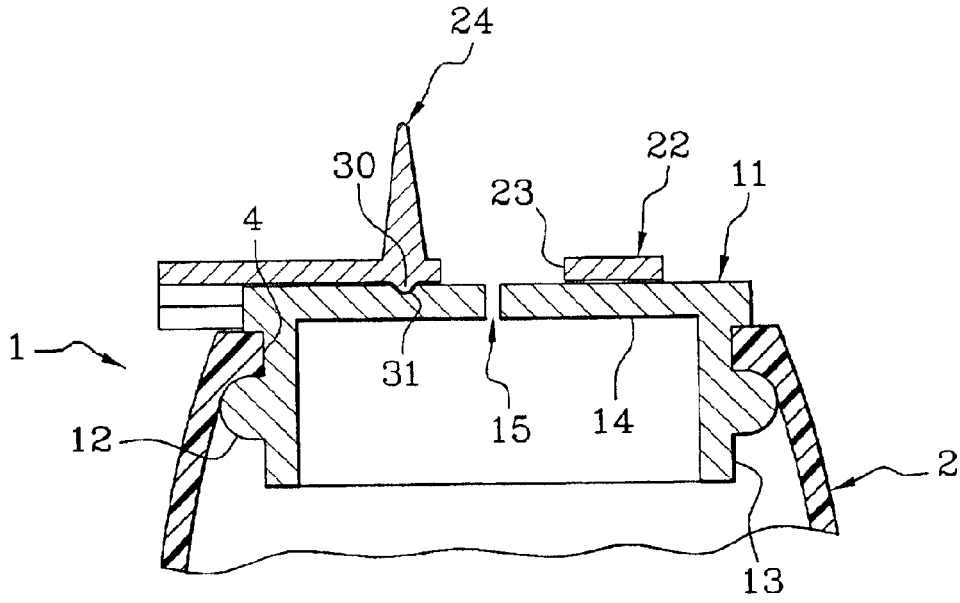

In the open position depicted in FIG. 7B, the bulge 30 is engaged with a groove 31, formed on the upper face of the transverse wall 14 of the band 11. The groove 31 runs parallel to the slot 15, over roughly the same length and may be formed, for example, so that it does not pass entirely through transverse wall 14. In this position of FIG. 7B, the slot 15 faces the aperture 23 of the movable support 22, and product may be applied. Also, with this embodiment it is possible, for example, to dispense product through the aperture 23, with, on one hand, the bulge 30 in combination with the groove 31 and, on the other hand, the bulge 30 in combination with the slot 15, thus delimiting the maximum travel of the slide of the movable support 22.

In the closed position depicted in FIG. 7A, the bulge 30 is engaged with the slot 15, which may improve the sealing-off of the slot. Furthermore, the collaboration between the bulge 30 and the slot 15 reversibly locks the applicator head in the closed position.

The device of this alternate embodiment in most other respects is substantially identical to the device of the previous embodiment.

On application, the process of use is similar to the one described with reference to the previous embodiment, it being understood that the device may be oriented in such a way that the slot 15 is upstream of the row of teeth 24. With this embodiment, the product is applied directly without preliminary preparation of the hair, as could be achieved using the row of teeth 16 in the previous embodiment.

Figure 8:
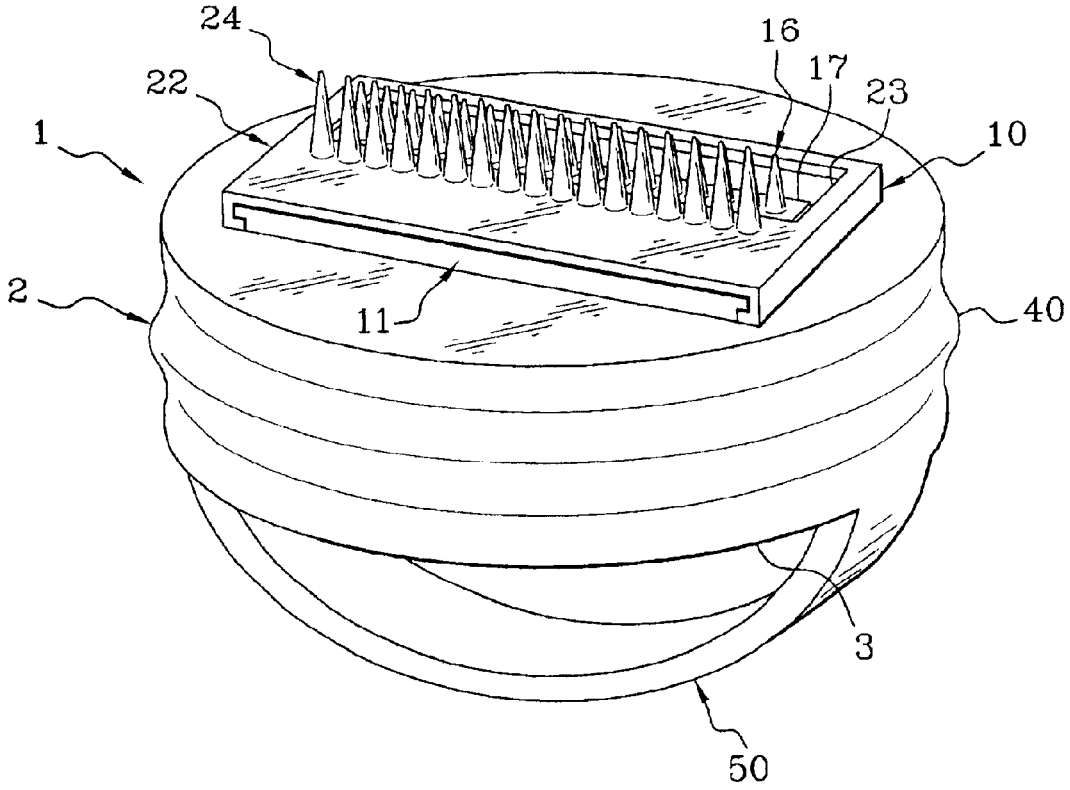
FIG. 8 is a perspective view of yet another exemplary embodiment of the applicator device.

In the embodiment of FIG. 8, the applicator head 10 is identical to that of the first embodiment, except that the teeth of the row 16 are slightly shorter than the teeth of the row 24. This height difference may make the action of passing the rows of teeth through the hair easier and may also inform the user as to the preferred orientation of the device when moving it through the hair.

Furthermore, the container is of circular cross section and shaped in the form of a bellows 40. The end wall 3 of the container is secured to a handle 50 that allows the device to be fitted over the hand, in a way similar to fitting a glove.

On application, the interaction between the applicator head, the product and the hair is substantially similar to that of the embodiment of FIGS. 1, 2, 3A, 3B, and 4. The difference lies substantially in the container in the way the device is held in the hand via the handle 50, and the fact that the product is expelled by axial compression of the container via the bellows 40 rather than lateral compression as in the previous embodiments.

It will be apparent to those skilled in the art that modifications and variations can be made to the structure and methodology described herein. Thus, it should be understood that the invention is not limited to the examples discussed in the specification. Rather, the present invention is intended to cover any modifications and variations.

What is claimed is:

1. A device for applying a product, comprising:

a container configured to contain the product; and an applicator head associated with the container, the applicator head comprising:

a plurality of applicator elements having a base and a free end, at least one opening communicating with the container and being configured to allow the product to be delivered outside the applicator elements at a location closer to the base than the free end, and a movable support configured to be movable between a first position in which the at least one opening is closed off and a second position in which the at least one opening is at least partially uncovered, wherein at least some of the applicator elements are mounted on the movable support, and wherein the movable support is configured to be movable from the second position to the first position.

2. The device of claim 1, wherein said at least some of the applicator elements comprises a row of applicator elements mounted on the movable support.

3. The device of claim 2, wherein when the movable support is in the second position, the at least one opening is outside a mean plane containing the row of applicator elements.

4. The device of claim 2, wherein the row of applicator elements mounted on the movable support is a first row of applicator elements and wherein the device further comprises a second row of applicator elements fixedly mounted on the applicator head.

5. The device of claim 4, wherein the at least one opening is outside a mean plane containing the second row of applicator elements.

6. The device of claim 4, wherein the first row of applicator elements is mounted on the movable support so as to move with respect to the second row in a direction substantially perpendicular to the second row.

7. The device of claim 4, wherein the applicator elements of the first row differ from the applicator elements of the second row in at least one characteristic.

8. The device of claim 7, wherein the at least one characteristic comprises at least one of length, spacing, and cross section.

9. The device of claim 4, wherein, when the movable support is in the second position, the at least one opening is arranged between the first row and the second row.

10. The device of claim 2, wherein, when the movable support is in the second position, the at least one opening is arranged on one side of the row.

11. The device of claim 2, wherein the at least one opening comprises at least one slot oriented parallel to the row of applicator elements and having a length substantially equal to a length of the row of applicator elements.

12. The device of claim 2, wherein, within the row of applicator elements, the applicator elements have substantially identical lengths measured from the base to the free end.

13. The device of claim 2, wherein, within the row of applicator elements, the applicator elements have different lengths measured from the base to the free end.

14. The device of claim 1, wherein the container comprises at least one compressible wall configured to generate increased pressure inside the container in response to pressure exerted on the wall, the increased pressure inside the container being capable of expelling product through the at least one opening when the movable support is in the second position.

15. The device of claim 14, wherein the container wall is elastically compressible.

16. The device of claim 1, wherein the container is made at least partially of a material comprising at least one of a polyethylene, a polyvinyl chloride, a complex based on aluminium, and a polyethylene/ethylene vinyl alcohol (EVOH)/polyethylene.

17. The device of claim 16, wherein the polyethylene comprises one of a low-density polyethylene and a very-low-density polyethylene.

18. The device of claim 1, wherein the container further comprises a handle.

19. The device of claim 18, wherein the handle is formed on an end wall of the container.

20. The device of claim 1, wherein the applicator head is mounted to the container by at least one of snap-fastening, screwing, bonding, and welding.

21. The device of claim 1, further comprising a sealing member configured to improve the sealing of the at least one opening when the movable support is in the first position.

22. The device of claim 21, wherein the sealing member comprises a bulge formed on a surface of the movable support facing the at least one opening, the bulge being configured to mate with the at least one opening when the movable support is in the first position.

23. The device of claim 1, wherein the movable support is slidably mounted on the applicator head.

24. The device of claim 1, wherein the applicator head is removably mounted on the container.

25. The device of claim 1, further comprising a lid configured to removably cap the applicator head.

26. The device of claim 1, further comprising product contained in the container.

27. The device of claim 26, wherein the product comprises a hair product.

28. The device of claim 27, wherein the hair product comprises at least one of a cream, a gel, and a paste.

29. The device of claim 27, wherein the hair product comprises a hair coloration product.

30. A method of applying product, comprising:

providing the device of claim 1;

passing product from the container and onto the applicator head via the at least one opening; and placing the applicator elements in contact with a location to apply product to the location.

31. The method of claim 30, further comprising moving the movable support to the first position before the passing of product.

32. The method of claim 31, further comprising moving the movable support to the second position after the product is applied.

33. The method of claim 30, wherein the product comprises a hair product and the location comprises hair.

34. The device of claim 1, wherein the device is configured to apply the product to hair.

35. The device of claim 1, further comprising a product contained in the container, wherein the product is a hair product.

36. A device for applying a product, comprising:

a container configured to contain the product; and an applicator head associated with the container, the applicator head comprising:

a plurality of applicator elements having a base and a free end, at least one opening communicating with the container and being configured to allow the product to be delivered outside the applicator elements at a location closer to the base than the free end, a movable support configured to be movable between a first position in which the at least one opening is closed off and a second position in which the at least one opening is at least partially uncovered, and a locking arrangement configured to reversibly lock the movable support in at least one of the first position and the second position, wherein at least some of the applicator elements are mounted on the movable support.

37. The device of claim 26, wherein the locking arrangement comprises a bulge formed on a surface of the support and being configured to mate with the at least one opening when the movable support is in the first position.

38. The device of claim 37, wherein the locking arrangement further comprises an indent configured to mate with the bulge when the movable support is in the second position.

39. A device for applying a product, comprising:

a container configured to contain the product; and an applicator head associated with the container, the applicator head comprising:

a plurality of applicator elements having a base and a free end, at least one opening communicating with the container and being configured to allow the product to be delivered outside the applicator elements at a location closer to the base than the free end, and a movable support configured to be movable between a first position in which the at least one opening is closed off and a second position in which the at least one opening is at least partially uncovered, wherein at least some of the applicator elements are mounted on the movable support, and wherein the plurality of applicator elements comprise teeth.

* * * * *